US012110605B2

(12) United States Patent
Iisaka

(10) Patent No.: US 12,110,605 B2
(45) Date of Patent: Oct. 8, 2024

(54) FILM-FORMING METAL SOLUTION AND METHOD OF FORMING METAL COATING

(71) Applicant: TOYOTA JIDOSHA KABUSHIKI KAISHA, Toyota (JP)

(72) Inventor: Hirofumi Iisaka, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 437 days.

(21) Appl. No.: 16/429,297

(22) Filed: Jun. 3, 2019

(65) Prior Publication Data

US 2019/0368062 A1 Dec. 5, 2019

(30) Foreign Application Priority Data

Jun. 5, 2018 (JP) ..... 2018-107911

(51) Int. Cl.
*C25D 3/30* (2006.01)
*C25D 3/32* (2006.01)

(52) U.S. Cl.
CPC ..... *C25D 3/30* (2013.01)

(58) Field of Classification Search
CPC ..... C25D 3/02; C25D 3/32; C25D 3/30
USPC ..... 205/261, 302, 300
See application file for complete search history.

(56) References Cited

U.S. PATENT DOCUMENTS 4,326,930 A * 4/1982 Nagel ..... C25B 9/23 205/164
4,885,064 A * 12/1989 Bokisa ..... C25D 3/56 205/252
2009/0098398 A1* 4/2009 Yanada ..... C25D 3/32 205/302
2015/0014178 A1* 1/2015 Hiraoka ..... C25D 17/005 205/261
2015/0122661 A1* 5/2015 Woertink ..... C25D 3/32 205/253
2015/0267310 A1* 9/2015 Ikumoto ..... C25D 3/60 205/253

(Continued)

FOREIGN PATENT DOCUMENTS

CN 101922026 A * 12/2010 ..... C25D 3/32
CN 104011269 A 8/2014
JP 2005-23374 A 1/2005

(Continued)

*Primary Examiner* — Edna Wong
(74) *Attorney, Agent, or Firm* — Sughrue Mion, PLLC

(57) ABSTRACT

The present disclosure relates to a film-forming metal solution for use in a method in which a solid electrolyte membrane having sulfonic acid groups is disposed between an anode and a substrate serving as a cathode, the solid electrolyte membrane is brought into contact with the substrate, and a voltage is applied between the anode and the substrate to deposit a metal onto a surface of the substrate from metal ions supplied into the solid electrolyte membrane and thereby form a metal coating on the surface of the substrate, the film-forming metal solution being adapted to supply metal ions into the solid electrolyte membrane, wherein the film-forming metal solution comprises an aqueous metal solution, a solvent, and a nonionic surfactant, and the nonionic surfactant has a linear hydrophilic group having ethylene oxide units and a hydrophobic group having a cyclic structure and a maximum length of 40 Å or less.

10 Claims, 3 Drawing Sheets

(56) References Cited

U.S. PATENT DOCUMENTS

| | | | |
|---|---|---|---|
| 2015/0329982 | A1 | 11/2015 | Miura et al. |
| 2019/0368063 | A1 | 12/2019 | Yamaguchi et al. |

FOREIGN PATENT DOCUMENTS

| | | | | | |
|---|---|---|---|---|---|
| JP | 2012-97319 | A | | 5/2012 | |
| JP | 2015-036449 | A | | 2/2015 | |
| JP | 5681916 | B2 | | 3/2015 | |
| JP | 2015-218366 | A | | 12/2015 | |
| JP | 2016-222991 | A | | 12/2016 | |
| JP | 2017031447 | A | * | 2/2017 | ..... C25D 3/32 |
| JP | 2017-057484 | A | | 3/2017 | |
| JP | 2017-125251 | A | | 7/2017 | |
| JP | 2017-222894 | A | | 12/2017 | |
| JP | 2018-35426 | A | | 3/2018 | |

* cited by examiner

FILM-FORMING METAL SOLUTION AND METHOD OF FORMING METAL COATING

CROSS REFERENCE TO RELATED APPLICATIONS

The present application claims priority from Japanese patent application JP 2018-filed on Jun. 5, 2018, the content of which is hereby incorporated by reference into this application.

BACKGROUND

Technical Field

The present disclosure relates to a film-forming metal solution and a method of forming a metal coating.

Background Art

A process called solid electrolyte deposition (SED) has been conventionally known as a method of forming a metal coating, and this process includes disposing a solid electrolyte membrane between an anode and a substrate serving as a cathode, providing an aqueous solution containing metal ions between the anode and the solid electrolyte membrane, bringing the solid electrolyte membrane into contact with the substrate, applying a voltage between the anode and the cathode, and pressurizing the aqueous solution to deposit the metal ions onto the cathode from the inside of the solid electrolyte membrane by means of the liquid pressure of the aqueous solution, thereby forming a metal coating made of the metal of the metal ions on the surface of the substrate (see JP 2018-035426 A).

JP 5681926 B2 (see [0063] of JP 5681926 B2) discloses a 0.2 mol/l aqueous tin sulfate solution (tin sulfate concentration: 40 g/l, sulfuric acid concentration: 100 g/l, cresol sulfonic acid concentration: 30 g/l, formalin (37%): 5 ml) as an electrolyte solution (reductant solution).

SUMMARY

In order to form a film of a metal such as tin by solid electrolyte deposition using a solid electrolyte membrane having sulfonic acid groups, an acidic metal solution needs to be used. The electrode potential of hydrogen generated by water decomposition depends on the pH, and this relationship is represented by the following equation.

$$E_H = -0.059 \times \mathrm{pH}$$

For example, an acidic tin bath has a pH of around −1 to 4, and it should therefore be understood, based on the pH-potential diagram, that formation of a film of tin by solid electrolyte deposition involves simultaneous generation of hydrogen and tin.

A solid electrolyte membrane commonly used in solid electrolyte deposition is one that has sulfonic acid groups. Specifically, there is used a perfluorosulfonic acid-based ion-exchange membrane such as Naflon (trade name) manufactured by E.I. du Pont de Nemours and Company, Flemion (trade name) manufactured by Asahi Glass Co. Ltd., Aciplex (trade name) manufactured by Asahi Kasei Corporation, or Gore-Select manufactured by W. L. Gore & Associates, Inc. These solid electrolyte membranes have a main chain in the form of polytetrafluoroethylene (PTFE) skeleton and a side chain containing an ether bond and a sulfonic acid group, and the main chain is hydrophobic while the side chain is hydrophilic. Thus, the main chain in the form of PTFE skeleton and the sulfonic acid group-containing side chain are phase-separated, and an ion channel structure is formed in which the side chain moiety having sulfonic acid groups holds hydrated water (water cluster).

In solid electrolyte deposition, metal ions such as tin ions move through ion channels of a solid electrolyte membrane and, therefore, the friction force due to water clusters and the size of the ion channels are considered to be key factors that determine the mobility of the metal ions (metal deposition rate). With the use of any conventional metal solution, however, the metal ions are easily attracted to the water clusters and thus are slow to reach the substrate. Consequently, hydrogen is more readily deposited on the substrate than the metal, and this causes formation of bubbles on the substrate, leading to uneven thickness (large surface roughness) of the resulting metal coating.

The present disclosure provides: a film-forming metal solution the use of which in solid electrolyte deposition allows metal ions to quickly reach a substrate by passing through a solid electrolyte membrane having an ion channel structure so as to render deposition of the metal more dominant on the substrate than generation of hydrogen, thus leading to a small surface roughness of the resulting metal coating; and a method of forming a metal coating using the film-forming metal solution.

The present disclosure is based on the finding that metal deposition can be rendered more dominant on a substrate than hydrogen generation to solve the above problem by using a nonionic surfactant as an additive to attract metal ions toward the nonionic surfactant which does not strongly attract water clusters and by specifying the structure of the nonionic surfactant to increase the efficiency of entry of the additive into the solid electrolyte membrane. That is, the gist of the present disclosure is as follows.

(1) A film-forming metal solution for use in a method in which a solid electrolyte membrane having sulfonic acid groups is disposed between an anode and a substrate serving as a cathode, the solid electrolyte membrane is brought into contact with the substrate, and a voltage is applied between the anode and the substrate to deposit a metal onto a surface of the substrate from metal ions supplied into the solid electrolyte membrane and thereby form a metal coating on the surface of the substrate, the film-forming metal solution being adapted to supply metal ions into the solid electrolyte membrane, wherein the film-forming metal solution comprises an aqueous metal solution, a solvent, and a nonionic surfactant, and the nonionic surfactant has a linear hydrophilic group having ethylene oxide units and a hydrophobic group having a cyclic structure and a maximum length of 40 Å or less.

(2) The film-forming metal solution according to (1), wherein the hydrophobic group has a minimum length of 10 Å or less.

(3) The film-forming metal solution according to (1) or (2), wherein the hydrophilic group has 9 to 15 mol of the ethylene oxide units.

(4) The film-forming metal solution according to any one of (1) to (3), wherein the nonionic surfactant has a hydrophilic-lipophilic balance of 13 to 15.

(5) The film-forming metal solution according to any one of (1) to (4), wherein the nonionic surfactant is a cumylphenol ethylene oxide adduct.

(6) The film-forming metal solution according to any one of (1) to (5), wherein the aqueous metal solution is an aqueous tin sulfate solution.

(7) A method of forming a metal coating, the method comprising: disposing a solid electrolyte membrane having sulfonic acid groups between an anode and a substrate serving as a cathode; bringing the film-forming metal solution according to any one of (1) to (6) into contact with the solid electrolyte membrane to supply metal ions into the solid electrolyte membrane; and, in conjunction with the supply of the metal ions, applying a voltage between the anode and the substrate while keeping the solid electrolyte membrane in contact with the substrate to deposit a metal onto a surface of the substrate from the supplied metal ions.

According to the present disclosure, the metal ions are attracted to the nonionic surfactant. The nonionic surfactant does not strongly attract water clusters, and thus the metal can be deposited on the substrate before deposition of hydrogen on the substrate. Consequently, a metal coating can be formed before formation of bubbles on the substrate, and the metal coating can have a small surface roughness.

Additionally, the specific structure of the nonionic surfactant allows the nonionic surfactant to easily enter ion channels of the solid electrolyte membrane and enables the metal ions to readily reach the substrate, thus leading to a further reduction in the surface roughness of the metal coating.

DETAILED DESCRIPTION

Figure 1:
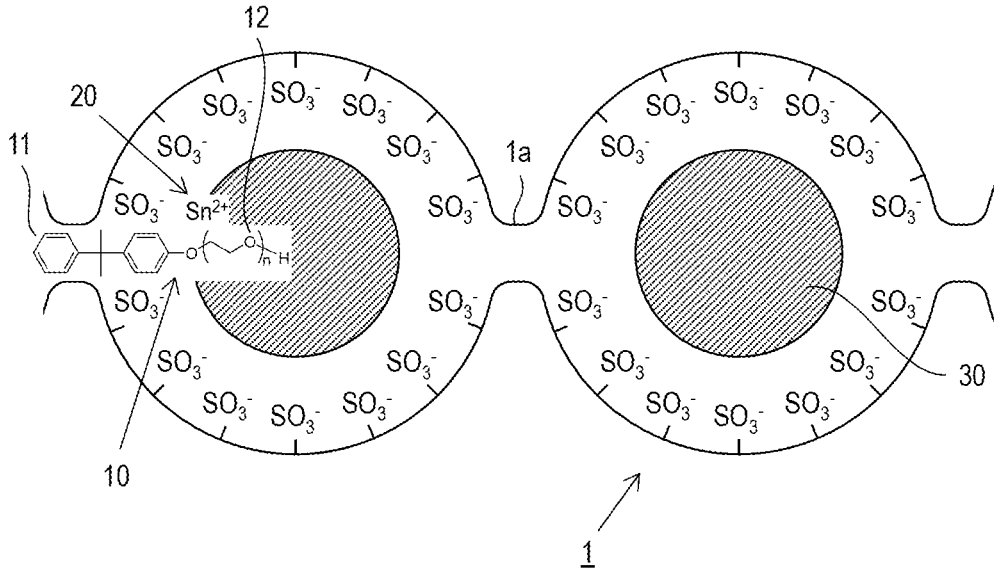
FIG. 1 is a schematic diagram for illustrating an ion channel structure in a solid electrolyte membrane in exemplary embodiments.

Hereinafter, exemplary embodiments will be described in detail.

A film-forming metal solution according to exemplary embodiments comprises an aqueous metal solution, a solvent, and a nonionic surfactant. The nonionic surfactant is characterized by having a linear hydrophilic group having ethylene oxide units and a hydrophobic group having a cyclic structure and a maximum length of 40 Å or less. Such a film-forming metal solution is for use in solid electrolyte deposition (SED) in which a solid electrolyte membrane having sulfonic acid groups is disposed between an anode and a substrate serving as a cathode, the solid electrolyte membrane is brought into contact with the substrate, and a voltage is applied between the anode and the substrate to deposit a metal onto a surface of the substrate from metal ions supplied into the solid electrolyte membrane. The film-forming metal solution is used to supply metal ions into the solid electrolyte membrane.

The aqueous metal solution can be selected as appropriate depending on the type of the metal to be formed into a film. Since solid electrolyte deposition uses a solid electrolyte membrane having sulfonic acid groups, an acidic metal solution is used as the aqueous metal solution in some embodiments. Specific examples of the acidic metal solution include a sulfuric acid solution, a methanesulfonic acid solution, and a fluoroborate solution. In particular embodiments, an aqueous tin sulfate solution is used to form a tin coating. The concentration of tin sulfate in the film-forming metal solution can be set as appropriate depending on the film formation conditions and may be in the range of 30 to 50 g/l in some embodiments. The pH of the aqueous tin sulfate solution is in the range of −0.1 to 0.4 in some embodiments in order to form a tin coating, but the pH of the aqueous tin sulfate solution is not limited to this range.

Any solvent can be used as long as the solvent dissolves both polar substances and non-polar substances and has no adverse effect on the solid electrolyte membrane. Examples of the solvent include isopropyl alcohol and 1-propanol. In typical embodiments, isopropyl alcohol is used. One of these solvents may be used alone, or two or more thereof may be used in combination. The amount of the solvent varies depending on the amounts of the other components, and may be, for example, in the range of 5 to 15 g/l in the film-forming metal solution.

A nonionic surfactant adsorbs to the crystal growth point of a metal such as tin and inhibits the crystal growth, thus providing a crystal size reduction leading to formation of a dense, smooth coating (see Mekki Gijutsu Gaido [Guidebook of Plating Technology], Nippon Tokin Zairyo Kyodokumiai [Japan Plating Material Cooperative Association]). The nonionic surfactant in exemplary embodiments has a linear hydrophilic group having ethylene oxide units and a hydrophobic group having a cyclic structure and a maximum length of 40 Å or less. The behavior of such a nonionic surfactant in a solid electrolyte membrane will be described hereinafter.

The solid electrolyte membrane used in exemplary embodiments has sulfonic acid groups. Specifically, in some embodiments, a perfluorosulfonic acid-based ion-exchange membrane is used (e.g., Nafion (trade name) manufactured by E.I. du Pont de Nemours and Company, Flemion (trade name) manufactured by Asahi Glass Co., Ltd., Aciplex (trade name) manufactured by Asahi Kasei Corporation, or Gore-Select (trade name) manufactured by W.L. Gore & Associates, Inc.). In typical embodiments, Nafion is used. The molecular structure of such a perfluorosulfonic acid-based solid electrolyte membrane has a main chain in the form of PTFE skeleton and a side chain containing an ether bond and a sulfonic acid group, and the main chain is hydrophobic while the side chain is hydrophilic. Thus, the main chain in the form of PTFE skeleton and the sulfonic acid group-containing side chain are phase-separated. A perfluorosulfonic acid-based polymer electrolyte membrane is a linear polymer material and holds a structure in which the hydrophobic moiety of the fluorinated carbon skeleton is crystalized (the degree of crystallization is estimated to be 25%) even without cross-linkage. The remaining side chain moiety having sulfonic acid groups is phase-separated as a hydrophilic moiety and forms an ion channel structure enclosing hydrated water (water cluster). FIG. 1 schematically shows such an ion channel structure. In the ion channel structure 1 of a solid electrolyte membrane, as shown in FIG. 1, the side chain moiety having sulfonic acid groups holds a water cluster 30 (the cluster diameter is estimated to be 40 to 45 Å). Upon application of a potential, metal ions 20 such as tin ions move in a direction from the anode to the cathode through the ion channels of the solid electrolyte membrane, and a nonionic surfactant 10 having a hydrophobic group 11 and a hydrophilic group 12 attracts and accompanies the metal ions 20. The ion channel structure of the solid electrolyte membrane and the water cluster diameter can be observed with an electron microscope or by small-angle X-ray scattering.

In order for a nonionic surfactant to efficiently enter a solid electrolyte membrane in solid electrolyte deposition, it is important that the nonionic surfactant be allowed to enter ion channels with little friction and be introduced into water clusters with little interaction (i.e., the nonionic surfactant be adhered and trapped on the inner walls of the ion channels of the solid electrolyte membrane). In exemplary embodiments, in order for the nonionic surfactant to enter ion channels with little friction, the hydrophilic group of the nonionic surfactant is linear ethylene oxide capable of being hydrogen-bonded to water clusters, and the hydrophobic group of the nonionic surfactant has a cyclic structure and a maximum length of 40 Å or less, which is smaller than the water cluster diameter. In some embodiments, the minimum length of the hydrophobic group of the nonionic surfactant is 10 Å or less.

The benzene ring, which is the cyclic structure, is a n-conjugated system, and thus can be smaller than the hydrophilic group composed of ethylene oxide and provide a reduction in the friction experienced by the nonionic surfactant entering ion channels. The maximum length of the hydrophobic group needs to be 40 Å or less in order for the nonionic surfactant to enter ion channels. In order for the nonionic surfactant to smoothly pass through a neck portion 1*a* of the ion channel structure 1 of FIG. 1, the maximum length may be 10 Å or less in some embodiments and 5 Å or less in particular embodiments. The terms "maximum length" and "minimum length" as used herein to describe a hydrophobic group respectively refer to the longest diameter and shortest diameter in an excluded volume calculated for the hydrophobic group moiety (for "excluded volume", see Kuwabara, *Polymer*. Vol. 18, No. 203, 1969, and Fukuda, *Scientific report of Toyo Soda Manufacturing Company, Ltd*., Vol. 16, No. 1, 1972). The excluded volume of the hydrophobic group moiety can be determined from the molecular weight and molecular structure. The molecular weight can be determined by gas chromatography mass spectrometry (JIS K 0123:2006) or high-performance liquid chromatography mass spectrometry (JIS K 0136:2015). The molecular structure can be determined by infrared spectroscopy (JIS K 0117:2000), gas chromatography mass spectrometry (JIS K 0123:2006), or quantitative nuclear magnetic resonance spectroscopy (JIS K 0138:2018).

The degree to which a nonionic surfactant is dissolved in water, i.e., the level of hydrophilicity of the surfactant (a measure of whether the hydrophilicity of a hydrophilic group is high or low relative to the hydrophobicity of a hydrophobic group) is defined by Griffin as a hydrophilic-lipophilic balance (HLB) specified below, and a correlation is found between the HLB and the nature of nonionic surfactants.

HLB of nonionic surfactant=(Molecular weight of hydrophilic group moiety)/(Molecular weight of nonionic surfactant)×100/5

=Hydrophilic group weight/(Hydrophobic group weight+hydrophilic group weight)×100/5

=Hydrophilic group concentration in % by weight×⅕

The hydrophilic-lipophilic balance (HLB) of the nonionic surfactant according to the present disclosure is in the range of 13 to 15 in some embodiments. When the HLB is in this range, a nonionic surfactant having osmotic effect, cleaning effect, and emulsifying effect (O/W type) is obtained. This nonionic surfactant easily penetrates a solid electrolyte membrane, and interaction between water clusters and the hydrophobic group of the nonionic surfactant is weak.

Particular examples of the nonionic surfactant as described above include ethylene oxide adducts of phenol derivatives such as cumylphenol, bisphenol, nonylphenol, and octylphenol and ethylene oxide adducts of naphthol derivatives such as α-naphthol and β-naphthol, and the phenol or naphthol derivative portion forms the hydrophobic group. Among these examples, a cumylphenol ethylene oxide adduct represented by the following formula is used in particular embodiments, since this adduct, which has carbon between two cyclic structures, can readily change its steric structure and easily enter ion channels.

[Formula 1]

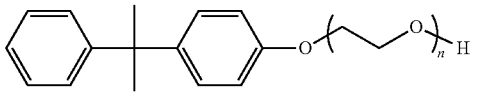

In solid electrolyte deposition, a potential is applied to electrophorese metal ions such as tin ions in the direction from the anode to the cathode through the solid electrolyte membrane. The nonionic surfactant has a hydrophilic group composed of linear ethylene oxide, and this ethylene oxide has an ether bond. The ether bond attracts the metal ions, and thus the nonionic surfactant accompanies the metal ions being electrophoresed. The entry of the nonionic surfactant into the solid electrolyte membrane during this process can be explained by polymer molecular dynamics simulation.

The polymer molecular dynamics simulation has become widely used since around 1990, and coarse-grained molecular dynamics (bead-spring model) aiming at reproducing the atomic-scale shape, excluded volume, and flexibility as accurately as possible has been applied (see K. Kremer and G. S. Greet, J. Chem. Phys., 92 (8), 5057 (1990) and Y. Cho, H. Watanabe and S. Granick, J. Chem. Phys., 110 (19), 9688 (1999)). The bead-spring model is applicable to the nonionic surfactant in exemplary embodiments because the linear ethylene oxide has a helical structure.

In the case of applying the bead-spring model to a nonionic surfactant, as shown in FIG. 1, when the nonionic surfactant 10 is introduced into the water cluster 30 and the terminal of the hydrophilic group 12 of the nonionic surfactant 10 enters the neck portion 1*a* of the ion channel structure 1, the vibration of the moiety of the hydrophilic group 12 in a direction orthogonal to the direction of electrophoresis of the metal ions 20 such as tin ions is reduced, and the terminal of the hydrophilic group 12 acts as a fixed end. Thus, if the hydrophobic group 11 of the nonionic surfactant 10 lies inside the water cluster 30 (if the length of the ethylene oxide is smaller or greater than the diameter of the water cluster 30), the hydrophilic group 12 at one terminal acts as a fixed end, whereas the hydrophobic group 11 at the other terminal acts as a free end. It is therefore inferred that the vibration of the hydrophobic group 11 in the direction orthogonal to the direction of electrophoresis of the metal ions 20 is not reduced, but rather the interaction (repulsive force) between the hydrophobic group 11 and the water cluster 30 is enhanced to decrease the efficiency of entry of the metal ions 20 and the nonionic surfactant 10. By contrast, if the size of the nonionic surfactant 10 is substantially equal to the diameter of the water cluster 30, not only does the hydrophilic group 12 at one terminal act as a fixed end but also the hydrophobic group 11 at the other terminal acts as a fixed end, and consequently both of the terminals of the nonionic surfactant 10 simultaneously enter the neck portion 1*a* of the ion channel structure 1. It is therefore thought that the vibration of the nonionic surfactant 10 in the direction orthogonal to the direction of electrophoresis of the metal ions 20 is reduced to allow the nonionic surfactant 10 to be introduced into the solid electrolyte membrane most quickly.

In view of the above, the number of ethylene oxide units of the nonionic surfactant according to the present disclosure is 9 to 15 mol in some embodiments. In other embodiments, the number of ethylene oxide units may be 11 to 13 mol. When the number of ethylene oxide units is in such a range, the size of the nonionic surfactant is substantially equal to the diameter of the water cluster, and the ethylene oxide chain has high flexibility, so that the nonionic surfactant is efficiently introduced into the neck portions of the ion channels of the solid electrolyte membrane. Additionally, since the ether bond contained in the hydrophilic group of the nonionic surfactant has a lone electron pair to which a metal ion can be coordinated and presents a negative electronegativity, the nonionic surfactant can come close to the metal ions such as tin ions and transfer the metal ions efficiently. This allows tin to be deposited preferentially over hydrogen gas generated by decomposition of the tin solution, thus reducing the surface roughness of the resulting metal coating and enabling the metal coating to be uniform and have gloss.

An excessively low concentration of the nonionic surfactant in the film-forming metal solution leads to a decrease in the amount of the nonionic surfactant present on the film formation surface and hence to a reduced efficiency of transfer of the metal ions, while an excessively high concentration of the nonionic surfactant leads to an increase in the amount of the nonionic surfactant in the vicinity of the ion channels and hence to an excluded volume effect which makes it difficult for the metal ions to pass through the ion channels. In view of the balance in this trade-off, the concentration of the nonionic surfactant is set as appropriate. Specifically, the concentration of the nonionic surfactant in the film-forming metal solution is in the range of 0.01 to 0.05 M in some embodiments.

In addition, the film-forming metal solution according to exemplary embodiments can, if necessary, contain an additive such as 2-mercaptobenzothiazole, gelatin, or polyethylene glycol nonylphenyl ether in order to improve solder spreadability. The concentrations of these additives are not particularly limited. In some embodiments, the concentration of 2-mercaptobenzothiazole is in the range of 3 to 8 ml/l, the concentration of gelatin is in the range of 1 to 3 g/l, and the concentration of polyethylene glycol nonylphenyl ether is in the range of 15 to 25 g/l.

A metal coating can be formed by solid electrolyte deposition using the film-forming metal solution described above. That is, the formation of a metal coating can be accomplished by: disposing a solid electrolyte membrane having sulfonic acid groups between an anode and a substrate serving as a cathode; bringing the film-forming metal solution into contact with the solid electrolyte membrane to supply metal ions into the solid electrolyte membrane; and, in conjunction with the supply of the metal ions, applying a voltage between the anode and the substrate while keeping the solid electrolyte membrane in contact with the substrate to deposit a metal onto the surface of the substrate from the supplied metal ions.

Metal ions present in the solid electrolyte membrane are deposited during film formation and, in addition, metal ions are supplied to the solid electrolyte membrane from the aqueous solution present on the anode side. Thus, by supplying the aqueous solution as needed, metal coatings of desired thickness can be successively formed on the surfaces of a plurality of substrates without replacement of the anode.

In the method of forming a metal coating according to some embodiments of the present disclosure, the formation of a metal coating may be carried out by pressurizing the metal ion-containing aqueous solution, with the solid electrolyte membrane being in contact with the substrate, and thereby applying a pressure to the substrate by means of the liquid pressure of the aqueous solution via the solid electrolyte membrane. In this case, according to the Pascal's law, the solid electrolyte membrane can apply a pressure uniformly over the surface of the substrate by means of the liquid pressure of the pressurized aqueous solution. Application of a voltage between the anode and the cathode in this pressurized state allows a metal coating of uniform thickness to be formed on the surface of the substrate.

The various conditions of the film formation, such as the voltage to be applied, can be set as appropriate depending on, for example, the film formation area, the type of the metal coating, and the intended thickness of the coating.

EXAMPLES

Hereinafter, exemplary embodiments will be described in more detail by means of Examples and Comparative Examples. The present disclosure is not limited to Examples given below.

(Method for Synthesis of Nonionic Surfactant)

For use as a nonionic surfactant in Examples, cumylphenol ethylene oxide adducts having 4 to 60 mol of ethylene oxide units were synthesized by addition reaction of ethylene oxides of different chain lengths with cumylphenol. The size of the cumylphenol moiety serving as a hydrophobic group was such that the maximum length was about 10 Å and the minimum length was about 3 Å.

Cresol sulfonic acid (ethylene oxide units: 0 mol) was used as a nonionic surfactant in Comparative Example 1. The size of the cresol moiety serving as a hydrophobic group was such that the maximum length was about 5 Å and the minimum length was about 3 Å.

(Experimental Method)

Figure 2:
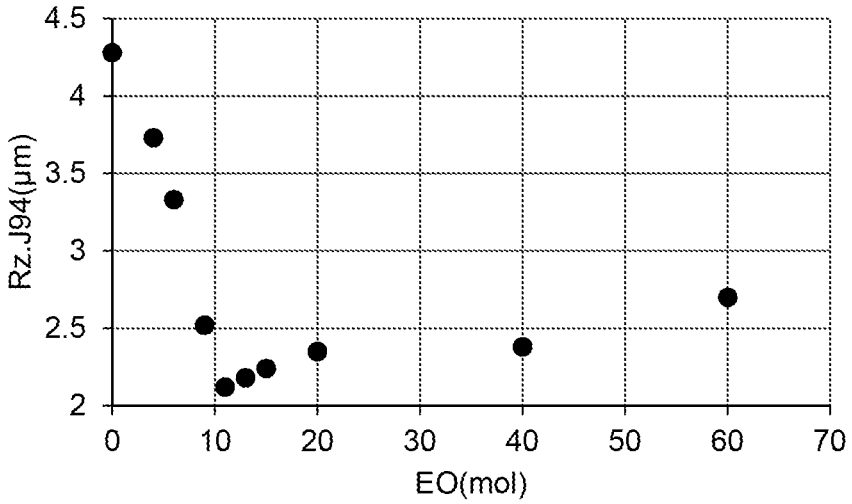
FIG. 2 is a graph showing the relationship between the number of ethylene oxide units in a nonionic surfactant and the surface roughness of a metal coating.
Figure 3:
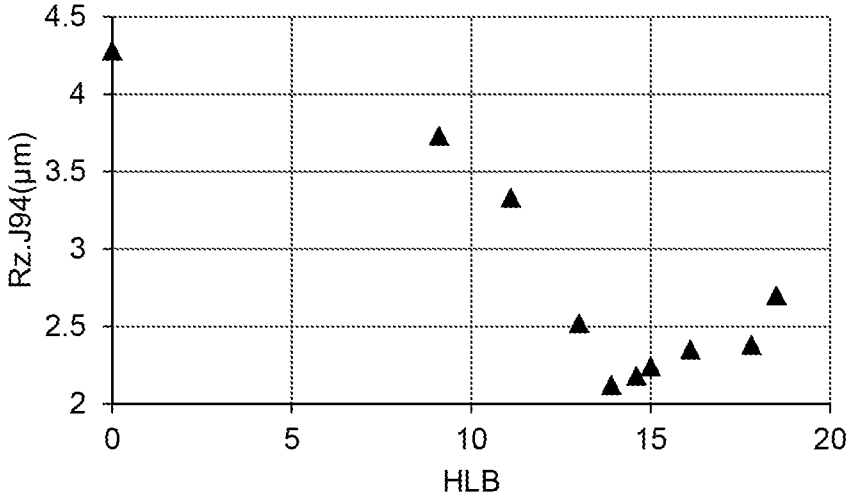
FIG. 3 is a graph showing the relationship between the hydrophilic-lipophilic balance (HLB) value of a nonionic surfactant and the surface roughness of a metal coating.

A nickel SED film (thickness: 4 μm, substrate: copper-sputtered substrate, current density: 100 mA/cm$^2$, electrolyte solution: 1 M aqueous nickel chloride solution+acetic acid (pH=4.0), temperature: 80° C. pressure: 0.5 MPa, size: 10×10 mm) was used as a substrate for surface morphology observation, which was used as a cathode. A solution containing a 0.19 M aqueous tin sulfate solution, a 0.014 M nonionic surfactant, and isopropyl alcohol (solvent) was prepared as a film-forming metal solution. In the solution, the concentration of tin sulfate was 40 g/l, the concentration of sulfuric acid was 100 g/l, and the concentration of IPA was 17 g/l. Using an ion-exchange membrane (N117, manufactured by E.I. du Pont de Nemours and Company) as a solid electrolyte membrane and a tin foil (SN-443261, manufactured by The Nilaco Corporation) as an anode, solid electrolyte deposition targeting a tin film thickness of 4 μm was performed at a substrate temperature of 40° C., a pressure of 0.50 MPa, a tin film formation area of 10×10 mm, and a voltage of 0.2 V to form a tin coating on the substrate. The film formation region was prepared by attaching a polyimide tape (Kapton Adhesive Tape: 650R#25, manufactured by Teraoka Seisakusho Co., Ltd.) on the substrate and forming a 10-mm-square opening in the polyimide tape. For the tin coating thus obtained, the surface roughness (ten-point average height, Rz.J94 (μm)) was measured. The measurement of the surface roughness was conducted using a probe-type surface roughness tester (SV-624, manufactured by Mitutoyo Corporation) according to JIS B 0601. The measurement results are shown in Table 1. The relationship between the number of ethylene oxide units in the nonionic surfactant and the surface roughness of the metal coating is shown in FIG. 2, and the relationship between the hydrophilic-lipophilic balance (HLB) value of the nonionic surfactant and the surface roughness of the metal coating is shown in FIG. 3. In the column headed "Uniformity" of Table 1, a metal coating having a Rz.J94 of 3 μm or less and having gloss is rated as "Good", a metal coating having a Rz.J94 of more than 3 μm and not more than 4 μm and/or lacking gloss is rated as "Average", and any other metal coating is rated "Poor".

TABLE 1

| | EO (mol) | HLB | Rz.J94 (μm) | Gloss | Uniformity |
|---|---|---|---|---|---|
| Example 1 | 4 | 9.1 | 3.73 | Semi-glossy | Average |
| Example 2 | 6 | 11.1 | 3.33 | Semi-glossy | Average |
| Example 3 | 9 | 13.0 | 2.52 | Glossy | Good |
| Example 4 | 11 | 13.9 | 2.12 | Glossy | Good |
| Example 5 | 13 | 14.6 | 2.18 | Glossy | Good |
| Example 6 | 15 | 15.0 | 2.24 | Glossy | Good |
| Example 7 | 20 | 16.1 | 2.35 | Semi-glossy | Average |
| Example 8 | 40 | 17.8 | 2.38 | Semi-glossy | Average |
| Example 9 | 60 | 18.5 | 2.70 | Semi-glossy | Average |
| Comparative Example 1 | 0 | 0.0 | 4.28 | Non-glossy | Poor |

Before formation of the tin film, the nickel layer alone had a Rz.J94 of 1.25 μm. As seen from Table 1, the formation of the tin coating on the nickel layer caused an increase in surface roughness in all of Examples and Comparative Example. A larger surface roughness of the tin coating deteriorates the solder wettability, and thus a smaller surface roughness of the tin coating is better. As shown in Table 1, all of the tin coatings of Examples 1 to 9, each of which used a nonionic surfactant having a linear hydrophilic group having ethylene oxide units and a hydrophobic group having a cyclic structure, a maximum length of 40 Å or less, and a minimum length of 10 Å or less, had a certain level of gloss and a relatively small surface roughness. In Comparative Example 1, in which the nonionic surfactant used had no linear hydrophilic group having ethylene oxide units, the obtained tin coating in which tin particles had a defined surface and a large particle size and which was not uniform. Moreover, this tin coating lacked gloss (non-glossy) and had a large surface roughness. A possible reason for the result of Comparative Example 1 is that generation of hydrogen occurred preferentially over deposition of tin, and hydrogen gathered at the interface between the solid electrolyte membrane and the nickel substrate to locally inhibit the contact between the solid electrolyte membrane and the nickel substrate, thus causing insufficient pressure application and hence uneven film formation.

When the number of ethylene oxide (EO) units was less than 9 mol, the EO length was smaller than 40 Å corresponding to the cluster diameter in the ion channel structure of the solid electrolyte membrane, and the tin coating was uneven and semi-glossy. When the number of EO units was more than 15 mol, the EO length was larger than the cluster diameter, and accordingly the efficiency of entry of the nonionic surfactant changed. Consequently, tin grew in the form of islands on the nickel film, and the resulting coating was semi-glossy. By contrast, as seen from Table 1 and FIG. 2, the tin coatings of Examples, in particular Examples 3 to 6, where the number of ethylene oxide (EO) units was in the range of 9 to 15 mol and the EO length was close to 40 Å corresponding to the cluster diameter, grew uniformly and exhibited superior gloss.

Comparative Example 2

A film-forming metal solution was prepared and a tin coating was formed on a nickel layer by solid electrolyte deposition, in the same manner as in Examples, except that a laurylamine ethylene oxide adduct having a hydrophobic group having no cyclic structure was used as a nonionic surfactant instead of the cumylphenol ethylene oxide adduct.

The laurylamine ethylene oxide adduct was synthesized as follows: 1 g of sodium hydroxide as a catalyst was added to 1 mol of laurylamine (C0684, Tokyo Chemical Industry Co., Ltd.) to give a solution, and this solution was heated to 165° C. and was allowed to absorb a necessary amount of ethylene oxide liquidized by pressurization and undergo addition reaction, the completion of which was followed by neutralization of sodium hydroxide with dilute sulfuric acid.

The tin coatings obtained using laurylamine ethylene oxide adducts having 7 mol, 14 mol, and 21 mol of EO units all had a portion devoid of deposited tin and were semi-glossy, irrespective of the number of moles of EO units.

Comparative Examples 3 and 4

A film-forming metal solution was prepared and an attempt was made to form a tin coating on a nickel layer by solid electrolyte deposition, in the same manner as in Examples, except that polyoxyethylene distyrenated phenyl ether having a hydrophobic group having a maximum length of about 150 Å and a minimum length of more than 10 Å (Comparative Example 3, EMULGEN A-60 manufactured by Kao Corporation, minimum length of hydrophobic group: about 15 Å) or polyoxyethylene tribenzyl phenyl ether having a hydrophobic group having a maximum length of about 150 Å and a minimum length of more than 10 Å (Comparative Example 4, EMULGEN B-66 manufactured by Kao Corporation, minimum length of hydrophobic group: about 15 Å) was used as a nonionic surfactant instead of the cumylphenol ethylene oxide adduct.

The result was that no tin coating was obtained. The reason for this result is presumably that failure of the nonionic surfactant to enter the ion channels of the solid electrolyte membrane caused insufficient tin ion transfer, which made formation of a tin coating difficult.

Comparative Example 5

A film-forming metal solution was prepared and an attempt was made to form a tin coating on a nickel layer by solid electrolyte deposition, in the same manner as in Examples, except that a cumylphenol propylene oxide/ethylene oxide adduct having a hydrophilic group moiety composed of propylene oxide/ethylene oxide copolymer (PO chain: 57%, EO chain: 43%) was used as a nonionic surfactant instead of the cumylphenol ethylene oxide adduct.

The result was that the current efficiency (the ratio of the weight of the deposited plating to the theoretical amount of deposited plating calculated according to the Faraday's law), as compared to that in the case of using the cumylphenol ethylene oxide adduct, decreased from 85% to 55% and a uniform tin coating was not obtained. This is presumably because the hydrophilic group of the nonionic surfactant was not linear, and the propylene oxide chain had a higher steric hindrance than the ethylene oxide chain, so that the nonionic surfactant had difficulty in entering the ion channels.

Examples 10 to 15

Film-forming metal solutions according to Examples 10 to 15 were prepared using a cumylphenol ethylene oxide adduct (EO units: 10 mol) as a nonionic surfactant with varying concentrations of the nonionic surfactant. Each of the film-forming metal solutions was used to form a tin coating on a nickel SED film by solid electrolyte deposition in the same manner as in Example 1. The current efficiency (%) calculated from the weight of the deposited plating is shown in Table 2.

TABLE 2

| | Concentration (M) of cumylphenol ethylene oxide adduct having 10 mol of EO | Current efficiency (%) |
|---|---|---|
| Example 10 | 0.01 | 70 |
| Example 11 | 0.02 | 81 |
| Example 12 | 0.04 | 85 |
| Example 13 | 0.06 | 85.8 |
| Example 14 | 0.08 | 82 |
| Example 15 | 0.1 | 65 |

In all of Examples 10 to 15, a uniform tin coating having a small surface roughness was obtained. In particular, in Examples 11 to 14 where the concentration of the cumylphenol ethylene oxide adduct was in the range of 0.02 to 0.08, a high current efficiency was achieved. By contrast, in Example 10 where the concentration of the cumylphenol ethylene oxide adduct was low and in Example 15 where the concentration of the cumylphenol ethylene oxide adduct was high, the current efficiency decreased to 70% or less. The reason for this result is presumably that the low concentration of the cumylphenol ethylene oxide adduct led to a decrease in the amount of the cumylphenol ethylene oxide adduct present on the film formation surface and hence to a reduced efficiency of transfer of the tin ions, while the high concentration of the cumylphenol ethylene oxide adduct led to an increase in the amount of the cumylphenol ethylene oxide adduct in the vicinity of the ion channels and hence to an excluded volume effect which made it difficult for the tin ions to pass through the ion channels.

DESCRIPTION OF SYMBOLS

1 Ion channel structure
1*a* Neck portion
10 Nonionic surfactant
11 Hydrophobic group
12 Hydrophilic group
20 Metal ion
30 Water cluster

What is claimed is:

1. A method of forming a tin coating, the method comprising:

disposing a solid electrolyte membrane having sulfonic acid groups between an anode and a substrate serving as a cathode;

bringing a film-forming metal solution into contact with the solid electrolyte membrane to supply tin ions into the solid electrolyte membrane; and in conjunction with the supply of the tin ions, applying a voltage between the anode and the substrate while keeping the solid electrolyte membrane in contact with the substrate to deposit tin coating onto a surface of the substrate from the supplied tin ions, wherein the film-forming metal solution comprises:

an aqueous tin sulfate solution, a solvent comprising isopropyl alcohol, and a nonionic surfactant, wherein the nonionic surfactant has a linear hydrophilic group having ethylene oxide units, and a hydrophobic group having a cyclic structure, wherein the hydrophobic group of the nonionic surfactant has a minimum length of less than 10 Å, a maximum length of 10 Å or less, and the maximum length is greater than the minimum length, wherein the hydrophilic group of the nonionic surfactant has 11 to 15 mol of the ethylene oxide units, wherein a concentration of the nonionic surfactant in the film-forming metal solution is 0.01 to 0.08 M, wherein an amount of the tin sulfate in the film-forming metal solution is 30 to 50 g/l, and wherein the nonionic surfactant has a hydrophilic-lipophilic balance of 13 to 15.

2. The method of forming a tin coating according to claim 1, wherein the minimum length of the hydrophobic group is 5 Å or more.

3. The method of forming a tin coating according to claim 1, wherein the hydrophilic group has 11 to 13 mol of the ethylene oxide units.

4. The method of forming a tin coating according to claim 1, wherein the nonionic surfactant is a cumylphenol ethylene oxide adduct.

5. The method of forming a tin coating according to claim 1, wherein a concentration of the nonionic surfactant in the film-forming metal solution is 0.02 to 0.08 M.

6. The method of forming a tin coating according to claim 1, wherein a pH of the film-forming metal solution is in the range of −0.1 to 0.4.

7. The method of forming a tin coating according to claim 1, wherein the nonionic surfactant is a cumylphenol ethylene oxide adduct having 11 to 13 mol of ethylene oxide units.

8. The method of forming a tin coating according to claim 1, wherein a surface roughness (ten-point average height, Rz.J94 (μm)) of the tin coating is 3 μm or less.

9. The method of forming a tin coating according to claim 1, wherein the solid electrolyte membrane having sulfonic acid groups is a perfluorosulfonic acid-based ion-exchange membrane.

10. The method of forming a tin coating according to claim 1, wherein the solid electrolyte membrane having sulfonic acid groups has a main chain in the form of polytetrafluoroethylene (PTFE) skeleton and a side chain containing an ether bond and a sulfonic acid group.

* * * * *